United States Patent [19]
Wiltgen, Jr.
[11] 4,444,671
[45] Apr. 24, 1984

[54] ARC EXTINGUISHING MATERIAL

[75] Inventor: Bernard M. Wiltgen, Jr., Villa Park, Ill.

[73] Assignee: S&C Electric Company, Chicago, Ill.

[21] Appl. No.: 671,319

[22] Filed: Mar. 29, 1976

[51] Int. Cl.[3] ..... H01H 9/30
[52] U.S. Cl. ..... 252/63.2; 200/144 A; 252/2; 525/154
[58] Field of Search ..... 252/2, 63.2, 63.5, 63.7, 252/5, 7, 571; 200/149 A, 144 C, 144 A; 174/DIG. 1, 137 B

[56] References Cited

U.S. PATENT DOCUMENTS

| | | | |
|---|---|---|---|
| 2,722,561 | 11/1955 | McCulloch | 174/17 |
| 3,535,289 | 10/1970 | Kato et al. | 174/137 B |
| 3,761,660 | 9/1973 | Jones | 200/144 C |

*Primary Examiner*—Josephine Barr
*Attorney, Agent, or Firm*—John D. Kaufmann

[57] ABSTRACT

An arc quenching composition suitable for deionizing and extinguishing a high voltage electrical arc comprising an effective proportion of hexamethylenetetramine. Depending on the application in which the arc extinguishing composition is employed, the hexamethylenetetramine may be utilized alone, admixed with a suitable binder, or used to impregnate another material.

26 Claims, No Drawings

ARC EXTINGUISHING MATERIAL

BACKGROUND OF THE INVENTION

1. Field of the Invention

The present invention relates to arc quenching materials for high voltage electrical devices and equipment wherein under certain conditions of operation a high voltage electrical arc is produced that must be quenched to eliminate an undesirable current flow. More particularly, the present invention relates to the use of hexamethylenetetramine as an arc quenching material in devices such as high voltage fuses, circuit breakers, circuit interrupters, lightning arresters, and separable cable terminations.

2. Description of the Prior Art

It is well known in the art that to provide effective circuit interruption it is desirable to utilize an arc quenching material or substance in circuit interrupters and similar devices such as fuses to quench and suppress arcing during contact separation or fuse operation. Typically a trailer-liner configuration is used in circuit interrupters so that the arc is drawn into the annular space between the trailer and liner, each of which may be formed from an arc quenching material. The action of the gases produced by the trailer or liner on the confined arc tends to deionize the arc and force its extinction. In a high voltage fuse, typically a sleeve or liner surrounds the path of the arc during fuse operation. Many nonconductive materials are capable of being fabricated into the desired shapes, but the arc quenching current-interrupting effectiveness of such materials varies and many such materials are less effective in providing repeated arc quenching capabilities after initial use. Typically, circuit interrupters, excepting fuses, have utilized Plexiglas (methyl methacrylate polymer) as a trailer material and Plexiglas, horn fiber, or Delrin (polyoxymethylene) as a liner material.

It is well known in the art that in order to perform properly, an arc quenching material should have three immportant qualities. First, the material should be highly effective in quenching arcs produced over a wide range of electrical operating conditions. The properties of the materials should be such that an arc extinguishing gas is evolved quickly and effectively with a minimum consumption of arc extinguishing material. By minimizing the consumption of the arc quenching material, its operating life is prolonged.

Secondly, the arc quenching material and its solid fused residue should be relatively nonconductive to avoid reestablishing a current flow through the device after it has operated.

Finally, the arc quenching material should be capable of being molded or compounded with other materials into a composition having sufficient structural properties for the particular device in which the arc quenching material is employed.

Other properties of the arc quenching material may also be important, such as thermal stability. It is also desirable that the arc quenching gas evolved be neither obnoxious nor toxic.

It has been discovered that hexamethylenetetramine is an effective and suitable arc quenching material.

SUMMARY OF THE INVENTION

The present invention concerns a new and improved arc quenching material comprising an effective proportion of hexamethylenetetramine. The hexamethylenetetramine may be utilized alone, admixed with a suitable binder, or used to impregnate other materials.

Therefore, it is a primary object of the invention to provide effective arc quenching compositions meeting the three primary requirements noted above.

Specifically, it is an object of the invention to provide an arc quenching material which is effective in quickly extinguishing high voltage electrical arcs over a wide range of electrical conditions and with a minimum consumption of the arc quenching material.

Yet another object of the invention is to provide an arc quenching material capable of being formed and compounded into arc quenching compositions having structural properties sufficient for use in a wide variety of devices and applications.

DETAILED DESCRIPTION OF THE PREFERRED EMBODIMENTS

The present invention concerns arc quenching compositions comprising an effective proportion of hexamethylenetetramine. Hexamethylenetetramine has the following general chemical structure:

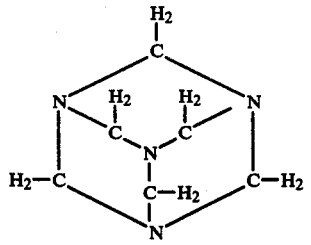

It has now been discovered that hexamethylenetetramine is an effective arc quenching material, i.e., the heat of a high voltage electrical arc causes hexamethylenetetramine to evolve a sufficient amount of deionizing and extinguishing gases that the electrical arc is extinguished rapidly and effectively. The gases evolved consist primarily of formaldehyde and ammonia but in such quantities as to be neither obnoxious nor toxic.

In some applications, hexamethylenetetramine may be utilized without the addition of other materials. In these instances hexamethylenetetramine may be molded or compressed directly into the form in which it is to be employed in the particular electrical equipment.

In a number of other uses, it may be desirable to employ hexamethylenetetramine with a binder. Suitable binders include thermoplastic and thermosetting organic resins, elastomers, and inorganic binders. Suitable thermoplastic or thermosetting organic resin binders include acrylonitrile butadiene styrene terpolymers, acetal copolymers and homopolymers, and acrylic, alkyd, allyl, cellulosic, epoxy, ionomer, polyallomer, polyethylene, polymethylpentene, polypropylene, and polystyrene resins.

Similarly, the following natural and synthetic elastomeric materials may be useful as binders in arc quenching compositions of this invention: natural rubber, styrene-butadiene rubbers, butyl rubber, ethylene-propylene rubbers, reclaimed rubber, polyacrylic rubber, Hypalon (chlorosulfonated polyethylene—a synthetic rubber), nitrile elastomers, silicone elastomers, fluorocarbon elastomers, polyurethane elastomers, synthetic polyisoprene, neoprenes, and polysulfide polymers. Suitable inorganic binders include portland cement, plaster of paris, clay, ceramics, and water glass (sodium silicate).

The foregoing examples are illustrative of suitable materials which may be utilized as binders to provide the requisite structural properties for the particular application in which the hexamethylenetetramine arc quenching composition of the present invention is to be employed. Other materials than those specifically listed may also be employed and the present invention is not limited to the examples listed above.

To further strengthen the arc quenching compositions, it may be desirable to employ additional fillers or fibers. Fibrous materials which may prove useful in particular applications include, among others, asbestos, cellulose, glass, inorganic materials, including ceramics, and synthetic organic fibers, such as polyacrylonitrile, polyamide and polyester fibers. Typical fillers include calcium carbonate, metal oxides, including alumina, beryllium oxide, magnesia and zinc oxide, comminuted polymers, and natural and synthetic silica materials. These materials are primarily employed to lend desirable structural properties to the arc quenching composition and to reduce cost. However, in some instances fibrous materials such as those listed may be impregnated with hexamethylenetetramine and utilized in this form without a binder. In addition, the arc quenching compositions may also include small amounts of other materials which have arc extinguishing ability or which enhance the arc extinguishing ability of hexamethylenetetramine. Such materials include, for example, hydrated alumina and boric acid.

The arc quenching compositions of the present invention typically include from 5.0 to 100.0 percent by weight of hexamethylenetetramine and preferably from 10 to 70 percent by weight hexamethylenetetramine. The minimum amount of hexamethylenetetramine which is effective in any composition and the most effective percentage of hexamethylenetetramine employed in any specific composition depends on the nature of the binder, fillers, and other effective arc quenching materials which are utilized. The minimum and most effective proportions of hexamethylenetetramine for particular circuit interrupting capabilities are primarily determined by empirical methods.

Numerous methods known in the art may be employed to incorporate hexamethylenetetramine into arc quenching compositions in which a fibrous support material or a binder is employed. For example, an aqueous solution of hexamethylenetetramine can be prepared and the solution used to impregnate the fibrous material preformed in the appropriate part of the electrical apparatus. The absorption of hexamethylenetetramine from the solution can be facilitated by applying a vacuum. Alternatively, the solution can be used to impregnate fibrous material which is then incorporated into the binder. Another alternative is to mill the hexamethylenetetramine and binder on a plastics mill and then transfer mold or extrude the mixture into the appropriate shape. Other suitable methods known in the art can be utilized to prepare the hexamethylenetetramine arc quenching compositions of this invention.

Some typical hexamethylenetetramine containing arc quenching compositions which may be employed include the following:

| Composition | Ingredients | |
|---|---|---|
| A | hexamethylenetetramine | |
| | (no additional materials) | |
| B | hexamethylenetetramine | 100 parts by weight |
| | polyethylene | 50 parts |
| C | hexamethylenetetramine | 20 parts |
| | nylon paper | 80 parts |
| D | hexamethylenetetramine | 100 parts |
| | polypropylene | 50 parts |
| E | hexamethylenetetramine | 100 parts |
| | bisphenol A liquid epoxy resin | 100 parts |
| | diethylenetriamine | 10 parts |
| | dibutyl phthalate | 20 parts |
| F | hexamethylenetetramine | 50 parts |
| | alumina trihydrate | 100 parts |
| | bisphenol A liquid epoxy resin | 100 parts |
| | diethylenetriamine | 10 parts |
| | dibutyl phthalate | 100 parts |
| G | hexamethylenetetramine | 100 parts |
| | polyester resin | 100 parts |
| | methyl ethyl ketone peroxide | 1 part |
| H | hexamethylenetetramine | 50 parts |
| | alumina trihydrate | 100 parts |
| | polyester resin | 100 parts |
| | methyl ethyl ketone peroxide | 1 part |

EXPERIMENTAL EVALUATIONS

The following tests were conducted to illustrate the effectiveness of hexamethylenetetramine as an arc quenching composition.

Evaluation 1

In this evaluation, arc interrupting compositions of the present invention were prepared and tested in a loadbreak device as described and illustrated as element 55 in U.S. Pat. No. 2,351,826 to Lindell et al. which is assigned to the assignee of the present invention. The composition utilized consisted of two-thirds by weight hexamethylenetetramine to one-third polyethylene ("2:1 H/P") corresponding to composition B above. The hexamethylenetetramine and polyethlene were compounded on a two-roll plastics mill and then transfer molded into liners (bore 65 of the device shown in the referenced patent) and trailers (75). Rather than using a stack of rings as shown in the referenced patent, the liners were molded in a one piece cylindrical form. The liners were approximately 3.4 inches long with outside and inside diameters of 0.87 inches and 0.63 inches, respectively. The trailers were molded on polyester glass fiber rods and were approximately 3.6 inches long and 0.60 inches in diameter. The liners and trailers were then installed in the loadbreak device and tested at a number of operating conditions as shown in Table I. The average time needed to quench the arc was determined and is reported in Table I. These results are compared to the results of similar tests performed on a standard arc extinguishing material ("STD") comprising a trailer fabricated of Plexiglas and a liner fabricated of Delrin. Test 1 tested the arcing time under load circuit conditions. Tests 2–6 evaluated the materials under fault switching conditions. The severity of tests 2–6 was increased by increasing the natural frequency of the transient recovery voltage. Testing of each material was continued until failure occurred or the limit of the test equipment was reached.

For the purposes of this test evaluation and the following test evaluations, it should be understood that the following terms have the following commonly well known definitions.

The "recovery voltage" refers to the 60 hertz voltage that appears across the switching device after interrupting the circuit. Recovery voltage is normally the open circuit voltage and the recovery voltage does not contain any transient components.

The "transient recovery voltage" is the voltage that appears across a switch or loadbreak device during the time when the switch goes from a current conducting state, i.e. when the voltage across the switch is nominally zero, to the time when the voltage is the 60 hertz recovery voltage described above. During fault switching, this transient recovery voltage oscillates at a usually high frequency and this frequency is called the "transient recovery voltage frequency." This oscillatory transient voltage overshoots the crest of the recovery voltage and can have a maximum value of twice the nominal recovery voltage.

The "power factor" is a measure of the reactive nature of the test circuit. For the purposes of these test evaluations, the smaller the power factor, the more severe is the peak of the transient recovery voltage, and consequently the test circuit is more severe.

TABLE I

| ELECTRICAL CONDITIONS | | | | RESULTS | | | |
|---|---|---|---|---|---|---|---|
| Recovery Voltage (kV) | Amperes (rms) | Power Factor | Transient Recovery Voltage Frequency (kHz) | No. of Operations 2:1 H/P | No. of Operations STD | Time (milliseconds) 2:1 H/P | Time (milliseconds) STD |
| | | | TEST 1 | | | | |
| 15.2 | 600 | 1 | — | 5 | 5 | 10.8 | 13.5 |
| 25 | 600 | 1 | — | 5 | 5 | 14.8 | 29.1 |
| 24 | 900 | 1 | — | 8 | 6 | 21.8* | 31.3 |
| | | | TEST 2 | | | | |
| 9 | 93 | .3 | 5 | 5 | 5 | 11.9 | 16.1 |
| 9 | 600 | .3 | 5 | 5 | 5 | 13.6 | 15.4 |
| 15.5 | 87 | .3 | 3.6 | 5 | 5 | 17.2 | 22.4 |
| 15.5 | 87 | .3 | 8.7 | 5 | 2 | 18.1 | F |
| 15.5 | 87 | .3 | 13.3 | 5 | 0*** | 22.6 | —*** |
| | | | TEST 3 | | | | |
| 15.5 | 590 | .34 | 4.3 | 3 | 3 | 10.5 | 17.3 |
| 15.5 | 590 | .34 | 8.6 | 3 | 3 | 11.3 | 16.5 |
| 15.5 | 590 | .34 | 11.3 | 3 | 2 | 12.5 | F |
| 15.5 | 590 | .34 | 14.6 | 3 | 0 | 16.3 | — |
| 15.5 | 590 | .34 | 18.2 | 3 | 0 | 21.3 | — |
| 15.5 | 590 | .34 | 20.8 | 1 | 0 | F** | — |
| | | | TEST 4 | | | | |
| 27 | 100 | .3 | 4.5 | 3 | 1 | F | F |
| | | | TEST 5 | | | | |
| 15 | 1200 | .3 | 5 | 3 | 3 | 14.0 | 14.2 |
| 15 | 1200 | .3 | 9.3 | 3 | 1 | 14.8 | F |
| 15 | 1200 | .3 | 14.3 | 3 | 0 | 17.5 | — |
| | | | TEST 6 | | | | |
| 14 | 2000 | .3 | 8.3 | 3 | 1 | F | F |

*One sample exhibited an external flashover caused by extraneous gas flow along the insulator surrounding the sleeve but this factor is not a measure of the effectiveness as an arc extinguishing material.
**F - the arc was not extinguished at the indicated conditions.
***Test was discontinued following a failure.

The data in Table I illustrates the ability of hexamethylenetetramine to rapidly extinguish electrical arcs produced over a variety of electrical conditions.

It should be noted that the two to one composition of hexamethylenetetramine and polyethylene ("2:1 H/P") material demonstrated substantially shorter arcing times under load conditions (Test 1) than the standard ("STD") material. Further under fault switching conditions, the 2:1 H/P material not only demonstrated shorter arcing times, but also demonstrated effectiveness in extinguishing arcs at more extreme conditions than the standard ("STD") material.

Evaluation 2

In this evaluation, arc quenching compositions were prepared employing 75 percent by weight hexamethylenetetramine and 25 percent polyethylene ("3:1 H/P"). Liners and trailers were prepared as in Evaluation 1 and incorporated into a loadbreak device as previously described. However, in place of the toggle linkage incorporated in the loadbreak device of the referenced patent, an air cylinder was used to provide the force to snap the electrical contacts apart and thereby form an arc.

The liners and trailers were then tested under the following two different sets of electrical conditions, and the results are reported in Table II. Similarly, the same tests were conducted on a standard ("STD") material comprising a liner fabricated of Delrin and a trailer fabricated of Plexiglas, and the results of these tests are also reported in Table II.

| | Test #1 | Test #2 |
|---|---|---|
| Recovery Voltage (kV) | 15.5 | 15.5 |
| Amperes (rms) | 40 | 46 |
| Power Factor | .27 | .60 |
| Transient Recovery Voltage Frequency (kHz) | 5.0 | 2.8 |

TABLE II

| Test | Material | No. of Operations | Clearance Between Sleeve & Trailer (ins.) | Average Arcing Time (milliseconds) | Weight Loss (grams/cycle*) (Sleeve) | Weight Loss (grams/cycle*) (Trailer) |
|---|---|---|---|---|---|---|
| 1 | 3:1 H/P | 25 | .034 | 35.08 | 0033 | .0033 |

TABLE II-continued

| Test | Material | No. of Operations | Clearance Between Sleeve & Trailer (ins.) | Average Arcing Time (milliseconds) | Weight Loss (grams/cycle*) (Sleeve) | (Trailer) |
|---|---|---|---|---|---|---|
| | STD | 25 | .038 | 44.33 | .0427 | .0430 |
| 2 | 3:1 H/P | 25 | .034 | 20.42 | .0012 | .0009 |
| | STD | 25 | .034 | 17.78 | .0013 | .0014 |

*As in Evaluation 1 alternating current at 60 hertz was utilized.

The data in Table II illustrate the ability of hexamethylenetetramine arc quenching compositions to effectively extinguish an electrical arc with a minimum consumption of arc quenching material. Further, in comparison, the 3:1 hexamethylenetetramine polyethylene material demonstrated significantly less weight loss than the standard material under the conditions of Test 1, and measurably less weight loss under the conditions of Test 2. Thus, as shown by this data, the hexamethylenetetramine arc quenching material may be repetitively and successfully employed without requiring replacement.

Evaluation 3

In this evaluation, arc quenching compositions were utilized in a high voltage fuse. Typically such devices contain an inner sleeve surrounding the path of the arc which is produced when the fuse operates. In the present example sleeves of several different materials were impregnated with an aqueous solution of hexamethylenetetramine under vacuum. The sleeves were then dried. Comparative weighing revealed that the sleeves had absorbed between 5 and 35 percent by weight hexamethylenetetramine. The sleeves were then tested under various electrical conditions selected to simulate as closely as possible actual fault conditions on transformers and the results are reported in Table III. The specifications for the various samples listed in Table III are given in Table IV. Samples B-1 through B-4 utilized nylon paper and samples B-5 through B-8 utilized cellulose paper. The tests were also conducted on standard ("STD") commercially available fuse link sleeves for comparison purposes, and the results of these tests are also reported in Table III.

TABLE III

| Sample | Test Conditions*** 27kV 9 kHz Clear* | 50 amp .80 PF Fail** | 27kV 14 kHz Clear | 100 amp .55 PF Fail | 27kV 20 kHz Clear | 200 amp .45 PF Fail | 27kV 18 kHz Clear | 400 amp .20 PF Fail |
|---|---|---|---|---|---|---|---|---|
| STD | 10 | 0 | 0 | 10 | 0 | 10 | 5 | 5 |
| B-1 | 3 | 0 | 5 | 0 | 3 | 0 | 3 | 0 |
| B-2 | 3 | 0 | 2 | 1 | 0 | 3 | 2 | 1 |
| B-3 | 3 | 0 | 3 | 2 | 3 | 0 | 3 | 0 |
| B-4 | 3 | 0 | 3 | 0 | 2 | 1 | 1 | 2 |
| B-5 | — | — | 3 | 0 | 2 | 1 | 2 | 1 |
| B-6 | — | — | 3 | 0 | 3 | 0 | 0 | 3 |
| B-7 | 3 | 0 | 2 | 1 | 3 | 0 | 3 | 0 |
| B-8 | — | — | 3 | 0 | 2 | 1 | 3 | 0 |

*Number of tests in which arc was successfully extinguished.
**Number of tests in which arc was not extinguished.
***Recovery voltage (kV), current (amp), transient recovery voltage frequency (kHz), and power factor (PF).

TABLE IV

| Sample | I.D. (in.) | Thickness (in.) | Length (in.) |
|---|---|---|---|
| B-1 | .210 | .03-.04 | 5⅝ |

TABLE IV-continued

| Sample | I.D. (in.) | Thickness (in.) | Length (in.) |
|---|---|---|---|
| B-2 | .210 | .03-.04 | 8¼ |
| B-3 | .260 | .03-.04 | 5⅝ |
| B-4 | .260 | .03-.04 | 8¼ |
| B-5 | .210 | .03-.04 | 5⅝ |
| B-6 | .210 | .03-.04 | 8¼ |
| B-7 | .260 | .03-.04 | 5⅝ |
| B-8 | .260 | .03-.04 | 8¼ |

The data in Tables III and IV again illustrate the effectiveness of hexamethylenetetramine as an arc quenching material, in this instance in the form of impregnated paper rather than in conjunction with a binder. It should be noted that at the 100 and 200 amp range, the various test samples demonstrated marked superiority over the standard commercially available sleeves. At the 400 amp range, most of the test samples demonstrated superiority over the standard commercially available sleeves.

I claim:

1. An arc quenching composition comprising:
an effective amount of hexamethylenetetramine, and
a material selected from the group consisting of a thermoplastic resin, a thermosetting resin, and elastomeric compound, and an inorganic binder.

2. An arc quenching composition comprising:
an effective amount of hexamethylenetetramine in the form of a compressed cake.

3. An arc quenching composition comprising:
an effective amount of hexamethylenetetramine, and
a binder comprising a material selected from the group consisting of polyethylene and polypropylene.

4. The arc quenching composition of claim 1 wherein said arc quenching composition includes a binder comprising polypropylene.

5. A method for quenching an electrical arc consisting of positioning an arc quenching composition comprising an amount of hexamethylenetetramine effective for arc quenching sufficiently near the arc so that the heat of the arc causes a sufficient quantity of deionizing and extinguishing gas to be emitted from the composition and effectively terminate the arc.

6. The method of claim 5 wherein hexamethylenetetramine comprises at least 5 percent by weight of the total arc quenching composition.

7. The method of claim 6 wherein the arc quenching composition also includes a thermoplastic binder.

8. The method of claim 6 wherein the arc quenching composition also includes a thermosetting binder.

9. The method of claim 6 wherein the arc quenching composition also includes an elastomeric binder.

10. The method of claim 6 wherein said arc quenching composition also includes an inorganic binder.

11. The method of claim 6 wherein said hexamethylenetetramine is impregnated in a fibrous material.

12. The method of claim 6 wherein said hexamethylenetetramine is in the form of a compressed cake.

13. The method of claim 6 wherein said arc quenching composition includes a binder comprising polyethylene.

14. The method of claim 6 wherein said arc quenching composition includes a binder comprising polypropylene.

15. The method of claim 5 wherein hexamethylenetetramine comprises from 10 to 70 percent by weight of the total arc quenching composition.

16. A method of rendering a structure capable of extinguishing an electrical arc in proximity thereto, comprising the step of including in said structure an amount of hexamethylenetetramine effective for arc quenching.

17. The method of claim 16 wherein hexamethylenetetramine comprises at least 5 percent by weight of the structure.

18. The method of claim 17 wherein the structure also includes a thermoplastic binder.

19. The method of claim 17 wherein the structure also includes a thermosetting binder.

20. The method of claim 17 wherein the structure also includes an elastomeric binder.

21. The method of claim 17 wherein the structure also includes an inorganic binder.

22. The method of claim 17 wherein said hexamethylenetetramine is impregnated in a fibrous material.

23. The method of claim 17 wherein said hexamethylenetetramine is in the form of a compressed cake.

24. The method of claim 24 wherein the structure includes a binder comprising polyethylene.

25. The method of claim 24 wherein the structure includes a binder comprising polypropylene.

26. The method of claim 23 wherein hexamethylenetetramine comprises from 10 to 70 percent by weight of the total structure.

* * * * *